US005703926A

United States Patent [19]

Bischof

[11] Patent Number: 5,703,926

[45] Date of Patent: Dec. 30, 1997

[54] X-RADIATOR WITH CONSTRAINT-COOLED ROTATING ANODE

[75] Inventor: Norbert Bischof, Roethenbach, Germany

[73] Assignee: Siemens Aktiengesellschaft, Munich, Germany

[21] Appl. No.: 821,440

[22] Filed: Mar. 21, 1997

[30] Foreign Application Priority Data

Mar. 29, 1996 [DE] Germany ..... 196 12 698.3

[51] Int. Cl.[6] ..... H01J 35/10

[52] U.S. Cl. ..... 378/200; 378/125

[58] Field of Search ..... 378/199–202, 378/125, 130

[56] References Cited

U.S. PATENT DOCUMENTS 4,993,055 2/1991 Rand et al. ..... 378/125

*Primary Examiner*—Craig E. Church

*Attorney, Agent, or Firm*—Hill, Steadman & Simpson

[57] ABSTRACT

X-radiator with an X-ray tube with a vacuum housing to which an anode and a cathode are firmly connected, has a coolant container that surrounds the X-ray tube and is filled with a coolant, and a radiation protection housing that surrounds the coolant container. The X-ray tube and the coolant container are rotatably seated relative to the radiation protection housing, with the drive of the X-ray tube and/or the coolant container operating such that the X-ray tube and the coolant container rotate around a rotational axis during operation of the X-radiator. An electron beam deflection system that is stationary with respect to the radiation protection housing is arranged inside the radiation protection housing.

14 Claims, 1 Drawing Sheet

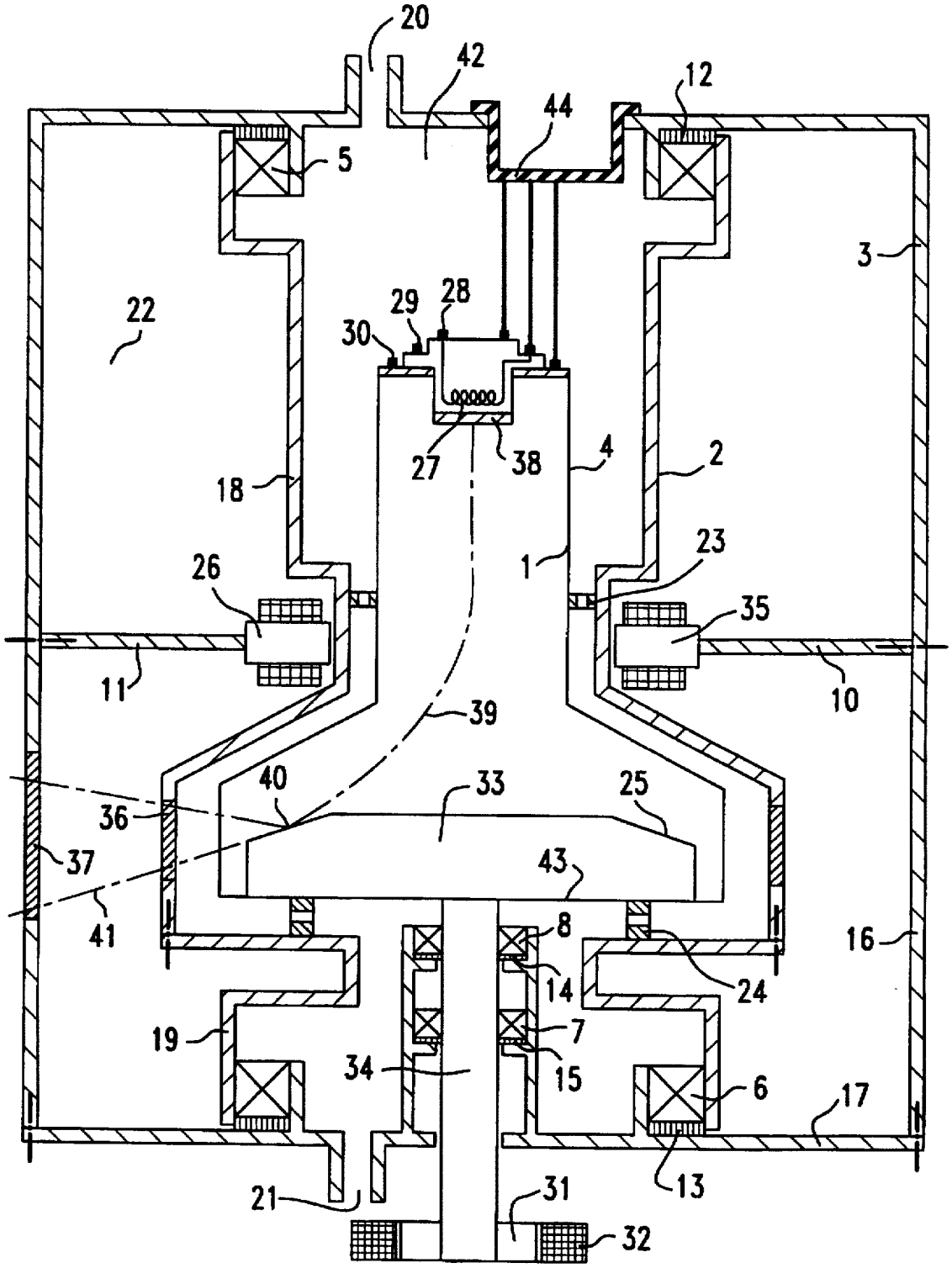
20
42
12
44
5
3
22
29
28
30
27
38
4
2
18
1
23
26
35
11
10
39
40
33
25
36
37
43
41
8
16
14
24
19
7
34
15
6
17
13
21
31
32

X-RADIATOR WITH CONSTRAINT-COOLED ROTATING ANODE

BACKGROUND OF THE INVENTION

1. Field of the Invention

The present invention is directed to an X-ray of the type having an X-ray tube with an anode and a cathode which are firmly joined to the vacuum housing, with the X-ray tube being surrounded by a radiation protection housing, the X-ray tube being rotatably seated with respect to the radiation protection housing, and wherein a stationary deflection system is provided for the electron beam emanating from the cathode.

2. Description of the Prior Art

An X-radiator usually contains an rotating anode X-ray tube whose rotating anode is accepted in the vacuum housing of the X-ray tube and is radiantly cooled. Direct cooling of the anode by a coolant, as is desirable because it allows a significant increase in the average electrical power, has been largely reserved for fixed anodes and can only be achieved with extremely great difficulty, if at all, given a rotating anode. In the case of rotating anode X-ray tubes, cooling by thermal conduction must ensue via the bearing system provided for the rotatable bearing of the rotating anode and only leads to slight quantities of conveyed (convected) heart even with the use of a complicated liquid metal friction bearing. The ball bearings running in the vacuum in a conventional rotating anode X-ray tube are also problematical because a wet lubrication of the ball bearings located inside the vacuum housing of the X-ray tube is, as a practical matter, precluded. X-ray tubes of this type therefore often tend to vibrate, which results in load running noises, and the service life of conventional rotating anode X-ray tubes is limited as a consequence of relatively high wear, with negative economic effects.

Previous solutions for increasing the average power of X-radiators with rotating anode X-ray tubes usually aim at making the rotating anode compatible for higher and medium powers by increasing the heat capacity and the radiation power of the anode itself. The limit of average electrical power that can be achieved by such means lies at about 10 kW. Since, however, the X-ray tubes become heavier and bulkier with increasing average electrical power, they can then only be manipulated with difficulty.

Other solutions aim at fashioning the X-ray tube as a so-called rotating tube whereby the tube itself rotates in an insulating or cooling medium. Such an X-radiator is disclosed, for example, in German Utility Model 87 13 042. This known X-ray tube, whose cathode and anode are firmly connected to the vacuum housing of the X-ray tube, is surrounded by a protective housing filled with an insulating oil and is seated therein so as to be rotatable around its center axis. The insulating oil, which also acts as coolant, circulates through the protective housing and thus allows elimination of excess heat occurring during operation of the X-radiator. In order to assure that the electron beam emanating from the cathode, arranged on the center axis of the X-ray tube, strikes the rotational axis in a stationary focal spot, a stationary deflection system for the electron beam is arranged outside the vacuum housing of the X-ray tube.

German PS 881 974 discloses an X-radiator with a rotating tube wherein the anode of the rotating tube is fashioned as a hollow anode which does not surround the cathode, and which projects from the glass body of the vacuum housing of the rotating tube, whereby the vacuum housing of the rotating tube rotates in a coolant and, in particular, the anode is cooled by the coolant.

Further, German OS 44 25 021 discloses an X-radiator with an X-ray tube whose vacuum housing rotates in a housing filled with a coolant, whereby a cylindrical wall region of the vacuum housing of the X-ray tube forms an axle bearing together with a cylindrical sleeve fastened to the wall in the inside of the housing.

High friction losses in the coolant occur during operation of this known X-radiator, and prove extremely problematical in such solutions, to the extent of representing a previously practically insurmountable problem in practice and opposing the introduction of such X-radiators.

SUMMARY OF THE INVENTION

An object of the present invention is to provide an X-radiator of the rotating tube type wherein the average electrical power is increased by direct cooling of the rotating tube without causing disruptive friction losses in the coolant.

The object is inventively achieved in an X-radiator with an X-ray tube that has a vacuum housing to which an anode and a cathode are firmly joined, with a coolant container surrounding the X-ray tube which is filled with a coolant, with a radiation protection housing that surrounds the coolant container. The X-ray tube and the coolant container are seated so as to be rotatable relative to the radiation protection housing. Means for driving the X-ray tube and/or the coolant container are fashioned such that the X-ray tube and the coolant container rotate in conjunction around a rotational axis during operation of the X-radiator. A deflection system that is stationary relative to the radiation protection housing is arranged inside the radiation protection housing and deflects the electron beam emanating from the cathode during operation of the X-ray tube such that it strikes the anode in a stationary focal spot as the anode rotates with the tube. According to the invention, thus, a direct charging of the X-ray tube with a coolant is possible, as a result of which heat elimination, and thus the average power of the X-radiator, can be noticeably increased. Because the X-ray tube and the coolant container are rotatably seated relative to the radiation protection housing of the X-radiator, it suffices to place either the X-ray tube or the coolant container into rotation, so that, by friction forces, the X-ray tube, the coolant container as well as the coolant rotate with substantially the same angular velocity relative to the radiation protection housing after a start-up phase. The friction losses in the coolant are thereby limited to a small region inside the coolant container, for example rolling bearings and/or seal rings. Consequently, the inventive X-radiator overcomes the previously existing problems of friction losses in the coolant that heretofore opposed a successful realization of X-radiators of the type initially described.

In an embodiment of the invention at least one admission and one discharge connection deliver and eliminate coolant to/from the coolant container, so that the coolant flows through the coolant container and a good cooling of the vacuum housing of the X-ray tube is achieved.

According to a preferred embodiment of the X-radiator, the X-ray tube and the coolant container are firmly connected to one another. This assures that the coolant container and the X-ray tube in fact rotate around the rotational axis with the same angular velocity within the stationary radiation protection housing, and are at rest relative to one another during operation of the X-radiator.

In one version of the invention, a section of the X-ray tube and the coolant container surrounding it, that lie in the region of the deflection system, have a reduced diameter compared to the anode, and the deflection system is arranged close to the outside wall of the coolant container. The diameter of the housing of the X-ray tube can thereby be reduced to such an extent that an unimpeded passage of the electron beam is just still possible. By arranging the deflection system close to the exterior wall of a housing section of the coolant container, and thus close to a housing section of the X-ray tube that has a reduced diameter compared to the anode, it is assured that the deflection system is arranged so close to the electron beam that the electron beam can be exactly deflected and defocussing phenomena are avoided. The inventive X-radiator thus assures a high imaging quality.

According to another version of the invention, rolling bearings, particularly ball bearings, that are located in the coolant on the side of the coolant container are provided for the rotatable support both of the X-ray tube and the coolant container relative to the radiation protection housing. A wet lubrication of the rolling bearings can be achieved in this way, as a result of which wear as well as vibrations, and thus running noises, can be greatly reduced. This feature contributes decisively to a lengthening of the service live of the X-radiator. A liquid, for example an insulating oil, is preferably provided as the coolant.

A further improvement in the heat elimination at the inventive X-ray tube can be achieved by making the anode, which represents the main heat source of the X-ray tube, form a part of the wall of the vacuum housing of the X-ray tube that is charged with the coolant.

According to another preferred embodiment of the invention, voltage supply to the X-ray tube ensues via wiper rings in the coolant. The voltage supply via wiper rings assures that the friction losses in the coolant remain limited to a small region. When the X-ray tube is provided with a driveshaft at the anode side, then the voltage supply of, for example, the anode can also be undertaken via the driveshaft when the driveshaft is implemented as, for example, a hollow shaft.

In another version of the invention the deflection system includes at least one electromagnet. The deflection of the electron beam, however, can alternatively ensue with permanent magnets, or electrostatically.

According to another embodiment of the invention, an electric motor or a pneumatic drive with or without gearing is provided as drive means. Since the coolant container and the X-ray tube are firmly connected to one another in a preferred embodiment of the invention, it sufficçs to drive either the coolant container or the X-ray tube. If the coolant container and the X-ray tube are not firmly connected to one another, so that the two can rotate independently of one another, either the coolant container or the X-ray tube can be driven. Both can be driven in exceptional cases.

DESCRIPTION OF THE DRAWINGS

The single FIGURE shows a longitudinal section through an inventive X-radiator.

DESCRIPTION OF THE PREFERRED EMBODIMENTS

The X-radiator of the invention shown in the FIGURE has an X-ray tube 1 that is surrounded by a coolant container 2 that is in turn surrounded by a radiation protection housing 3. The coolant container 2 and the radiation protection housing 3 are respectively composed of screwed-together upper housing and lower parts 18 and 19, upper and lower screwed-together housing parts 16 and 17 (only the center lines of a few screws are shown). Additionally, two carrier parts 10 and 11 that carry two electromagnets 26 and 35 (described in detail later) are screwed to the radiation protection housing 3. The coolant container 2 and the vacuum housing 4 of the X-ray tube 1 are rotatably seated relative to the stationary radiation protection housing 3 with rolling bearings, namely ball bearings 5 through 8. The coolant container 2 is thus rotatably seated relative to the radiation protection housing 3 with the ball bearings 5 and 6. By contrast, the vacuum housing 4 of the X-ray tube 1, which is torsionally connected to a shaft 34 at one end, is rotatably seated relative to the radiation protection housing 3 with the ball bearings 7 and 8. Whereas the X-ray tube 1 is evacuated, a coolant 42 flows through the coolant container 2. The coolant 42 is supplied to the coolant container 2 via an admission connector 20, for example with a pump and two lines (not shown), and is discharged therefrom via a discharge connector 21. The inside of the radiation protection housing 3 is filled with air. As warranted, a partial vacuum can also prevail in the inside of the radiation protection housing 3.

In the present exemplary embodiment, the vacuum housing 4 of the X-ray tube 1 and the coolant container 2 are fashioned dynamically balanced and are torsionally connected to one another via annular connecting parts 24. The annular connecting parts 23 and 24 thereby produce a clamp connection between the coolant container 2 and the vacuum housing 4 of the X-ray tube 1.

The annular connecting part 23 is thereby executed as a flat ring with axially proceeding openings, whereas the annular connecting part 24 is executed tube-like with radially proceeding openings. The openings which are present over the entire circumference of the connecting parts 23 and 24 in uniform spacings from one another enable an unimpeded circulation of the coolant in the inside of the coolant container 2, and thus over the exterior wall of the vacuum housing 4 of the X-ray tube 1, allowing a good cooling of the vacuum housing 4 of the X-ray tube 1 to be achieved.

An insulating oil is used as coolant 42 in the present case. In order to prevent insulating oil from emerging from the coolant container into the protective radiation housing 3, seal rings 12 through 15 are present at locations critical therefor in the region of the ball bearings 5 through 8. It is self-evident that the coolant 42 surrounding the X-ray tube 1 cannot enter into the vacuum housing 4 of the X-ray tube 1.

It proves especially advantageous for the ball bearings 5 through 8 in the inside of the coolant container 2 lie in the insulating oil 42, as a result of which a wet lubrication of the ball bearings 5 through 8 is assured. The tendency of the ball bearings 5 through 8 to vibrate, and thus to produce running noise, as well as the wear of the ball bearings 5 through 8, are greatly reduced in this way and a greater stability and longer service life of the X-radiator are achieved.

As also shown in the drawing, an electric motor that has a rotor 31 torsionally connected to the shaft 34 and a stator 32 is provided at the free end of the shaft 34 of the X-ray tube 1. The X-ray tube 1 and the coolant container 2 connected thereto can be placed in rotation with the electric motor around a rotational axis that corresponds to the longitudinal axis of the shaft 34, and thus also corresponds to the common center axis of X-ray tube 1 and coolant container 2. The drive can alternatively ensue with a pneumatic drive, whereby a gearing can be provided, if necessary, dependent on the applied situation.

During operation of the X-radiator, the X-ray tube 1 and the coolant container 2 firmly connected to one another rotate around the rotational axis inside the stationary radiation protection housing 3. The insulating oil thereby rotates with the same angular velocity as the X-ray tube 1 and the coolant container 2. As a result—differing from known X-radiators of this type—the friction in the insulating oil remains limited to small regions, namely the region of a cathode plug 44 (yet to be described), the admission and discharge connectors 20 and 21, the ball bearings 5 through 8 and the seal rings 12 through 15.

A cathode 38 and an anode 33 are schematically indicated in FIG. 1 in the inside of the X-ray tube 1, these being firmly connected to the vacuum housing 4 of the X-ray tube, so that they rotate in common with it. The components are arranged so that the rotational axis proceeds through the cathode 38. The anode has an annular incident surface 25 for an electron beam 39 emanating from the cathode 38, this being shown as a dot-dash line in the FIGURE. In order to enable the electron beam 39 to strike the incident surface 25, whose middle axis corresponds to the rotational axis, a deflection system for the electron beam 39 is provided, formed by two electromagnets 26 and 35 lying opposite one another. This deflection system is stationarily attached to the two carrier parts 10 and 11 between the cathode 38 and the anode 33 outside the vacuum housing 4 of the X-ray tube and outside the coolant container 2 but inside the radiation protection housing 3. Under the influence of the magnetic fields generated with the electromagnets 26 and 35, whose poles facing toward the electron beam 39 differ in polarity, the electron beam 39 is deflected so that it strikes the incident surface 25 of the anode 39 in a stationary focal spot 40 from which an X-ray beam 41 (shown with broken lines) proceeds.

To allow unimpeded emergence of the X-ray beam 41 from the X-radiator, the coolant container 2 and the radiation protection housing 3 have beam exit windows 36 and 37, the beam exit window 36 of coolant container 2 being annularly fashioned.

The cathode 38 and the heating coil 27 of the X-ray tube 1 are electrically contacted toward the exterior via wiper rings 28 through 30 that are applied onto contact surfaces that lie in the insulating oil in the inside of the coolant container 2. A cathode plug 44 that, introduced into the radiation protection housing so as to extend into the inside of the coolant container 2, and produces the contact to the wiper rings 28 through 30, supplies the heating coil 27 with the filament current, and applies a negative high-voltage to the cathode 38. The anode 33 of the X-ray tube lies at ground.

As can be seen from FIG. 1, the anode 33 is directly thermally conductively connected to the floor 43 of the housing of the X-ray tube 1, which is in turn directly charged with the insulating oil as coolant 42. An effective elimination of the waste heat arising upon incidence of the electron beam 39 onto the incident surface 25 is thus guaranteed.

In the region of the deflection system formed by the electromagnets 26 and 36, the vacuum housing 4 of the X-ray tube 1 and the coolant container 2 also have a housing part that is hollow-cylindrical in the described exemplary embodiment and that exhibits a reduced diameter compared to the anode 33. The deflection system, i.e. the electromagnets 26 and 35 at the carrier parts 10 and 11, are arranged close to the outside of this housing section of the coolant container 2. Since the electromagnets 26 and 35 are thus arranged close to the electron beam, this can be exactly deflected. Further, defocussing phenomena of the electron beam by the deflection system are avoided.

For rotation of the X-ray tube 1 and the coolant container 2, moreover, the X-ray tube 1 need not necessarily be provided with a driveshaft 34. For example, the coolant container 2 can also have a gearwheel or belt drive and thus be placed in rotation in common with the X-ray tube 1. Further, the driveshaft 34 need not necessarily be provided at the anode side but could be attached at the cathode side. Accordingly, the electrical contacting of the anode 33 can likewise ensue via a wiper ring.

When the X-ray tube 1 and the coolant container 2 are not rigidly connected to one another, then either the X-ray tube 1 or the coolant container 2 can be placed into rotation via an appropriate drive, as a result of which the X-ray tube 1, the coolant container 2 and the coolant 42 rotate with at least approximately the same angular velocity due to friction after a start-up phase. If it is expedient, the X-ray tube 1 and the coolant container 2, however, can be placed into rotation independently of one another via a corresponding drive.

The support of the vacuum housing 4 of the X-ray tube 1 as well as of the coolant container 2 in the radiation protection housing 3 can ensue not only with rolling bearings, but also with friction bearings if this is expedient.

Further, the number of admission or discharge connectors of the coolant 42 in the radiation protection housing need not necessarily be limited to one each. On the contrary, a plurality of admission or discharge connectors in conjunction with a high-capacity pump system can improve the circulation of the coolant, and thus the heat elimination.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray radiator comprising:

an X-ray tube having a vacuum housing with an anode and a cathode rigidly mounted in said vacuum housing, said cathode emitting an electron beam;

a coolant container surrounding said X-ray tube and filled with a coolant;

a radiation protection housing surrounding said coolant container;

means for mounting said X-ray tube and said coolant container in said radiation protection housing for permitting rotation of said X-ray tube and said coolant container relative to said radiation protection housing;

drive means for rotating at least one of said X-ray tube and said coolant container in said radiation protection housing around a rotational axis during operation of said X-ray tube, said X-ray tube emitting an X-ray beam during said operation; and deflection means, disposed inside said radiation protection housing and mounted stationarily relative to said radiation protection housing, for deflecting said electron beam onto a stationary focal spot on said anode.

2. An X-ray radiator as claimed in claim 1 wherein said coolant container has at least one coolant admission connector and at least one coolant discharge connector for respectively admitting and discharging coolant to and from said coolant container.

3. An X-ray radiator as claimed in claim 1 further comprising means for rigidly connecting said X-ray tube and said coolant container to each other.

4. An X-ray radiator as claimed in claim 1 wherein said anode has a diameter and wherein said X-ray tube and said coolant container respectively have coinciding sections of a diameter less than said diameter of said anode, and wherein said deflection means is disposed adjacent an exterior of said section of said coolant container.

5. An X-ray radiator as claimed in claim 1 wherein said means for mounting said X-ray tube and said coolant container in said radiation protection housing comprise rolling bearings.

6. An X-ray radiator as claimed in claim 5 wherein said rolling bearings are disposed in said coolant at said coolant container.

7. An X-ray radiator as claimed in claim 1 wherein said coolant comprises a liquid.

8. An X-ray radiator as claimed in claim 1 wherein said coolant comprises insulating oil.

9. An X-ray radiator as claimed in claim 1 wherein said anode forms a portion of a wall of said vacuum housing.

10. An X-ray radiator as claimed in claim 1 further comprising means for supplying operating voltage to said X-ray tube, including wiper rings exposed to said coolant.

11. An X-ray radiator as claimed in claim 1 wherein said deflection means comprises at least one electromagnet.

12. An X-ray radiator as claimed in claim 1 wherein said drive means comprises a prime mover with gearing connected between said prime mover and said at least one of said X-ray tube and said coolant container.

13. An X-ray radiator as claimed in claim 12 wherein said prime mover comprises an electric motor.

14. An X-ray radiator as claimed in claim 12 wherein said prime mover comprises a pneumatic drive.

* * * * *